US011459829B1

(12) United States Patent
Sanchez et al.

(10) Patent No.: US 11,459,829 B1
(45) Date of Patent: Oct. 4, 2022

(54) BI-DIRECTIONAL "REAM ON CLEAN" WELLBORE REAMER TOOL

(71) Applicant: KP Oiltech Inc., Edmonton (CA)

(72) Inventors: Kaidel Martinez Sanchez, Hamilton (CA); Pawel Sampolski, Edmonton (CA); Conrad Sampolski, Edmonton (CA)

(73) Assignee: KP OILTECH INC., Alberta (CA)

( * ) Notice: Subject to any disclaimer, the term of this patent is extended or adjusted under 35 U.S.C. 154(b) by 0 days.

(21) Appl. No.: 17/205,784

(22) Filed: Mar. 18, 2021

(51) Int. Cl.

| | |
|---|---|
| ***E21B 17/22*** | (2006.01) |
| ***E21B 10/26*** | (2006.01) |
| ***E21B 7/28*** | (2006.01) |
| ***E21B 7/00*** | (2006.01) |

(52) U.S. Cl.
CPC ..... *E21B 7/28* (2013.01); *E21B 7/005* (2013.01)

(58) Field of Classification Search
CPC ..... E21B 17/1078; E21B 17/22; E21B 17/10; E21B 10/26; E21B 10/32; E21B 17/1057
See application file for complete search history.

(56) References Cited

U.S. PATENT DOCUMENTS 2,589,534 A * 3/1952 Buttolph ..... E21B 17/1078 175/306
4,190,124 A * 2/1980 Terry ..... E21B 10/26 175/325.4
4,662,461 A * 5/1987 Garrett ..... E21B 17/1078 175/325.4
5,445,222 A * 8/1995 Pritchard ..... E21B 7/061 116/298
9,273,519 B2 * 3/2016 Smith ..... E21B 10/26
2003/0089499 A1 * 5/2003 Ohmer ..... E21B 29/06 166/298
2010/0212970 A1 * 8/2010 Radford ..... E21B 10/62 175/325.1
2010/0326738 A1 * 12/2010 Boulet ..... E21B 17/1078 175/324
2011/0114338 A1 * 5/2011 Casassa ..... E21B 17/1078 166/382
2012/0132469 A1 * 5/2012 Robson ..... E21B 10/26 175/53
2013/0146361 A1 * 6/2013 Makkar ..... E21B 10/32 175/57

(Continued)

*Primary Examiner* — Kipp C Wallace
(74) *Attorney, Agent, or Firm* — Kirsten M. Oates; Rodman & Rodman LLP

(57) ABSTRACT

A wellbore reamer tool for use in downhole oil well operations includes two helical impellers, two cutting portions, and an integral blade stabilizer. The first helical impeller is positioned at a downhole end for cleaning the wellbore of formation cuttings in advance of reaming by the cutting portions, and directing the formation cuttings to a desired position on the first cutting portions. The first and second cutting portions include radially insertable cutter inserts having cutters for reaming the wellbore to yield the formation cuttings. An integral blade stabilizer is positioned between the cutting portions for supporting the tool while driving uphole flow of the formation cuttings. A second helical impeller is positioned above the second cutting portions for cleaning the wellbore and boosting newly incorporated formations cuttings uphole towards surface.

22 Claims, 13 Drawing Sheets

(56) References Cited

U.S. PATENT DOCUMENTS

| | | | | |
|---|---|---|---|---|
| 2014/0299380 | A1* | 10/2014 | Machocki | E21B 37/00 175/57 |
| 2016/0138342 | A1* | 5/2016 | Svendsen | E21B 7/28 175/325.5 |
| 2017/0356253 | A1* | 12/2017 | Bailey | E21B 17/042 |

* cited by examiner

BI-DIRECTIONAL "REAM ON CLEAN" WELLBORE REAMER TOOL

FIELD OF THE INVENTION

The present invention relates to tools for drilling a wellbore in a formation, and more particularly to a bi-directional "ream on clean" wellbore reamer tool.

BACKGROUND OF THE INVENTION

A wellbore reamer is a rotary cutting tool used for drilling oil and gas wells to enlarge the diameter of a wellbore being drilled through a subsurface formation to a specified size, smooth the wall of the wellbore, help stabilize the bottom hole assembly, straighten the wellbore if kinks or doglegs are encountered, and drill directionally. The reamer rotates about a longitudinal axis of the drill string. The reamer includes cutting structures for enlarging the diameter of the wellbore in a subterranean formation by shearing, crushing, and/or cracking wellbore walls of the formation during rotation of the drill string. In use, high forces are exerted on the cutting structures, particularly in the forward-to-rear direction. Over time, the working surface or cutting edge of each cutter that continuously contacts the formation eventually wears down and/or fails.

Further, the quality of the wellbore produced when drilling can have a dramatic impact on the total well construction time and cost and sometimes can even determine success or failure. Wellbore quality is generally related to the "smoothness" of the wellbore or the "tortuosity." Tortuosity refers to undesirable deviations from the planned wellbore trajectory, corresponds to wellbore irregularities or oscillations, and can take many shapes, such as spiraling, rippling and hour-glassing. Spiraling occurs when the center of the drill bit follows a more or less helical path around the true centerline of the planned wellbore trajectory. A spiraled wellbore has a significant impact on drilling efficiency and cost. "Micro-tortuosity" refers to the induced deviation from the planned wellbore trajectory while drilling at a much smaller survey interval, typically every one to three feet, and is visible only when using a high resolution survey tool recorded at approximately one survey per foot. In the absence of any specific technology to improve the quality of the wellbore, there is little recognition of the potential benefits that might be achieved should some reamer tool be available for drilling a "truer" wellbore, one that followed a straighter line or smoother arc with minimal deviation. Reduction or elimination of tortuosity is widely regarded by those skilled in the art as a significant success factor in drilling operations.

Further, such problems contribute to the increment of the friction factor while drilling. The friction factor can be considered as the force resisting the relative rotation and downhole or uphole motion of the drill string. A high friction factor means a further degradation of the drilling conditions as the tool is working under high levels of drag and torque. Conversely, a low friction factor characterizes a high-quality wellbore with a smooth path which is desirable before running casing on the wellbore. Some downhole reamers are meant for "dedicated reamer run," meaning that once the hole is drilled, the operator pulls the drill string out of the hole to replace the downhole tools and to include a "dedicated reamer" on the drill string to conditionate the wellbore before running casing. The "reaming while drilling technology" allows use of a specifically designed downhole reamer to ream the wellbore while drilling is in progress. Such reamers have been proven to reduce friction during drilling operations, and obviate the need for a dedicated reamer run after reaching total depth. Those skilled in drilling operations are familiar with the effect of cuttings settling on the lower side of the wellbore once the flow or the rotation has ceased. By resuming drilling operations, the cuttings already settled start to move slowly to surface once rotation is provided to the drill string and a flow rate is re-established. Usually cutting structures in other reamers are required to work through the cuttings domes and do not have clear access to the wellbore walls during certain time periods, which not only reduces the effectiveness of the tool but also increases the torque as more friction is added.

SUMMARY OF THE INVENTION

The present invention relates to a wellbore reamer tool used in downhole oil well operations, specifically in reaming while drilling applications without distinction between back reaming operations and front reaming operations. In particular, the present invention relates to a bi-directional "ream on clean" wellbore reamer tool featuring a unique "ream on clean technology" as will be described herein. As used herein, the term "bi-directional" refers to the tool's capacity to shear the wellbore in back reaming operations and front reaming operations. As used herein, the terms "ream" and "reaming" refer to enlarging the diameter of a wellbore being drilled through a subsurface formation to a desired size and smoothing the radial wall of the wellbore. As used herein, the terms "ream on clean technology" or "ream on clean" refer to the tool's capacity to expose the clean wellbore surface to the cutting inserts as a downhole impeller has placed the cuttings settlements back in circulation. A wellbore surface clean of cuttings and debris before reaming improves the cutting action of the cutting inserts which will subsequently ream on a clean wellbore.

In addition, the wellbore reamer tool includes several beneficial features, notably two helical impellers, two cutting portions, and an integral blade stabilizer. The first helical impeller is positioned at a downhole end for lifting and directing uphole flow of formation cuttings to a precise position between the blades of the first cutting portions. The first helical impeller provides a wellbore clean of cuttings and debris before reaming in order to improve the cutting action of the cutting inserts which will subsequently ream on a clean wellbore. The cutting portions define pockets for mounting radially insertable and field replaceable cutting inserts comprising cutters for reaming the wellbore to yield the formation cuttings. An integral stabilizer comprising "S"-shaped stabilizer blades is positioned between the cutting portions for providing radial and tilt support while driving the formation cuttings uphole. The second helical impeller is positioned above the second cutting portions for boosting newly incorporated formations cuttings generated by the cutting portions uphole towards surface.

Broadly, in one aspect, the invention comprises a wellbore reamer tool positionable on a drill string in a wellbore comprising:

- a first helical impeller positioned at a downhole end for cleaning the wellbore of formation cuttings in advance of reaming by first and second cutting portions, and directing the formation cuttings to a desired position on the first cutting portions;
- the first and second cutting portions comprising a plurality of radially insertable cutter inserts comprising cutters for reaming the wellbore to yield the formation cuttings;

an integral blade stabilizer positioned between the first and second cutting portions for supporting the tool while driving uphole flow of the formation cuttings; and a second helical impeller positioned above the second cutting portions for cleaning the wellbore and boosting newly incorporated formations cuttings uphole towards surface.

In some embodiments, the tool further comprises a downhole end having a threaded pin connection for coupling to a bottom hole assembly or a drill pipe, and an uphole end having a threaded box connection for coupling to the drill string.

In some embodiments, the tool further comprises downhole spiral hardbands positioned at the downhole end and uphole spiral hardbands positioned at the uphole end for proving erosion protection.

In some embodiments, each of the first helical impeller and the second helical impeller comprises a plurality of helical blades and helical grooves between the helical blades for allowing uphole flow of formation cuttings therethrough.

In some embodiments, the helical blades comprise odd blades and even blades, the even blades comprising straight-edged extension blades.

In some embodiments, each of the first and second cutting portions comprises a bladed portion defining a plurality of pockets configured for mounting cutter inserts and wedge retainers.

In some embodiments, the bladed portion comprises a plurality of substantially straight-edged and axially extending blades spaced evenly and radially around the bladed portion about a central longitudinal axis of the tool.

In some embodiments, the pockets are spaced evenly and radially around the bladed portion about the central longitudinal axis, and positioned between the blades.

In some embodiments, the pockets comprise rims defining notches, opposed end walls, opposed side walls, and bases for seating the cutter inserts, the bases defining apertures for receiving attachment means therethrough for securing the cutter inserts within the pockets.

In some embodiments, the cutter inserts are positioned within the pockets, and spaced evenly and radially around the bladed portion about the central longitudinal axis, and positioned between the blades.

In some embodiments, each cutter insert comprises a cutter insert body defining a first recess and a second recess configured for receiving the cutters, the cutters being arranged linearly in an inner row and an outer row and inclined at a predetermined angle.

In some embodiments, each of the first and second recesses is aligned substantially parallel to each other, with the second recess being positioned below the first recess.

In some embodiments, the cutters are evenly spaced apart in the first recess to be positioned in an alternating fashion with the cutters evenly spaced apart in the second recess.

In some embodiments, the cutters comprise polycrystalline diamond compact cutters.

In some embodiments, the cutter insert is secured within the pocket by fixedly attaching the wedge retainers to the bladed portion.

In some embodiments, a wedge retainer is positioned at each end of the cutter insert body, and defines openings corresponding with the apertures in the bases of the pockets for receiving attachment means for securing the cutter insert to the blade portion.

In some embodiments, the integral blade stabilizer comprises a plurality of substantially "S"-shaped stabilizer blades, and an outer diameter larger than outer diameters of the first cutting portion and the second cutting portion.

In another aspect, the invention comprises a method of enlarging a wellbore diameter comprising:

positioning in the wellbore a drill string including a wellbore reamer tool attached thereto, the wellbore reamer tool including:

a first helical impeller positioned at an downhole end;

first and second cutting portions comprising a plurality of radially insertable cutter inserts comprising cutters;

an integral blade stabilizer positioned between the first and second cutting portions; and a second helical impeller positioned above the second cutting portions; and moving the drill string and the wellbore reamer tool longitudinally in the wellbore while rotating the drill string and the wellbore reamer tool.

In some embodiments, the method further comprises rotating the first helical impeller to clean the wellbore of formation cuttings in advance of reaming by the first and second cutting portions.

In some embodiments, the cutters engage and ream the radial wall of the wellbore to generate the formation cuttings, with an inner row of the cutters reaming before an outer row of the cutters.

In some embodiments, the method further comprises rotating the integral blade stabilizer for driving uphole flow of the formation cuttings while supporting the wellbore reamer tool.

In some embodiments, the method further comprises rotating the second helical impeller for cleaning the wellbore and boosting newly incorporated formations cuttings uphole towards surface.

Additional aspects and advantages of the present invention will be apparent in view of the description, which follows. It should be understood, however, that the detailed description and the specific examples, while indicating preferred embodiments of the invention, are given by way of illustration only, since various changes and modifications within the scope of the invention will become apparent to those skilled in the art from this detailed description.

BRIEF DESCRIPTION OF THE DRAWINGS

The invention will now be described by way of an exemplary embodiment with reference to the accompanying simplified, diagrammatic, not-to-scale drawings. In the drawings.

DETAILED DESCRIPTION OF PREFERRED EMBODIMENTS

Notation and Nomenclature

Figure 1:
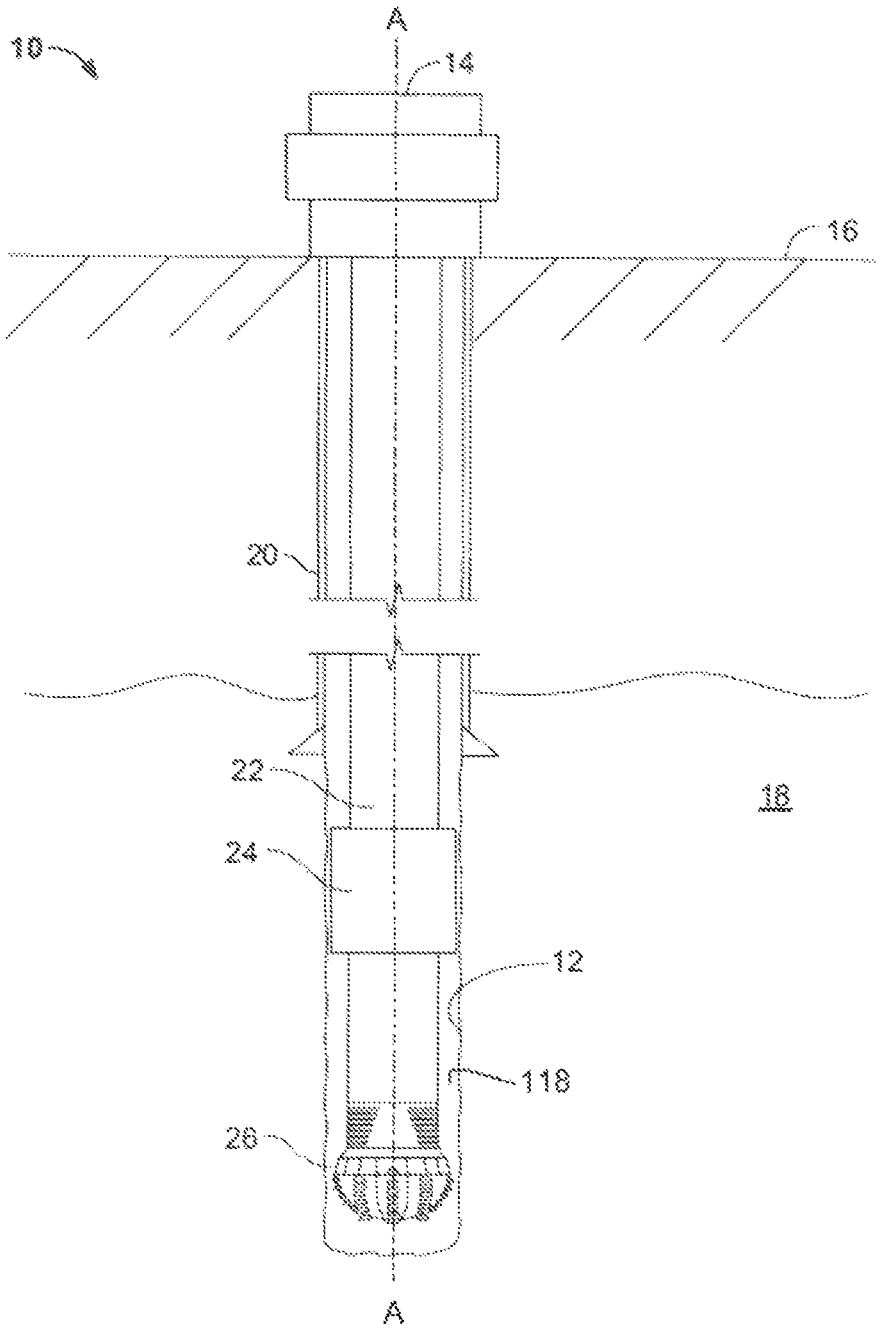
FIG. 1 (PRIOR ART)
FIG. 1 (PRIOR ART) is a schematic partial cross-sectional elevation view of an example well system.

Certain terms are used throughout the following description and claims to refer to particular components and configurations. As one of ordinary skill will appreciate, companies may refer to a component by different names. This document does not intend to distinguish between components that differ in name but not function. In the following discussion and in the claims, the singular forms "a," "an," and "the" include plural referents unless the context clearly dictates otherwise. The terms "including," "comprises," and "comprising" are used in an open-ended fashion, and thus should be interpreted to mean "including, but not limited to . . . ", and as referring to elements, components, or steps in a non-exclusive manner, indicating that the referenced elements, components, or steps may be present, or utilized, or combined with other elements, components, or steps that are not expressly referenced. Also, the term "couple," "couple," or "coupling" is intended to mean either a direct or indirect physical connection, an indirect connection as being through other components. In interpreting the disclosure, all terms should be interpreted in the broadest possible manner consistent with the context.

The disclosure may repeat reference numerals and/or letters in the various examples or figures. This repetition is for the purpose of simplicity and clarity and does not in itself dictate a relationship between the various embodiments and/or configurations discussed. Further, spatially relative terms, such as beneath, below, lower, above, upper, uphole, downhole, upstream, downstream, and the like, may be used herein for ease of description to describe one element or feature's relationship to another element(s) or feature(s) as illustrated, the upward direction being toward the top of the corresponding figure and the downward direction being toward the bottom of the corresponding figure. The uphole direction refers to the direction along the longitudinal axis of the wellbore that leads back to the surface, or away from the drill bit. In a situation where the drilling is more or less along a vertical path, downhole is truly in the down direction and uphole is truly in the up direction, but in horizontal drilling, the terms up and down are ambiguous, so the terms downhole and uphole are used to designate relative positions along the drill string. The downhole direction refers to the direction along the longitudinal axis of the wellbore that looks toward the furthest extent or toe of the wellbore. Downhole is also the direction toward the location of the drill bit and other elements of the bottom-hole assembly. Similarly, in a wellbore approximating a horizontal direction, there is a "high" side of the wellbore and a "low" side of the wellbore, which refer to those points on the circumference of the wellbore that are closest and farthest, respectively, from the surface of the land or water.

Unless otherwise stated, the spatially relative terms are intended to encompass different orientations of the apparatus in use or operation in addition to the orientation depicted in the figures. For example, if an apparatus in the figures is turned over, elements described as being "below" or "beneath" other elements or features would then be oriented "above" the other elements or features. Thus, the exemplary term "below" can encompass both an orientation of above and below. The apparatus may be otherwise oriented (rotated 90 degrees or at other orientations) and the spatially relative descriptors used herein may likewise be interpreted accordingly.

Moreover, even though a figure may depict a horizontal wellbore or a vertical wellbore, unless indicated otherwise, it should be understood by those skilled in the art that the apparatus according to the present disclosure is equally well-suited for use in wellbores having other orientations including, deviated wellbores, multilateral wellbores, or the like. Likewise, unless otherwise noted, even though a figure may depict an onshore operation, it should be understood by those skilled in the art that the apparatus according to the present disclosure is equally well-suited for use in offshore operations and vice-versa.

Bi-Directional "Ream on Clean" Wellbore Reamer Tool

FIG. 1 (PRIOR ART) is a schematic partial cross-sectional elevation view of a well system 10 that generally includes a generally cylindrical wellbore 12 extending from a wellhead 14 at the surface 16 downward into the earth into a subterranean zone 18 corresponding to a single formation, a portion of a formation, or more than one formation accessed by the well system 10, and a given well system 10 can access one, or more than one, subterranean zone 18. After some or all of the wellbore 12 is drilled, a portion of the wellbore 12 extending from the wellhead 14 to the subterranean zone 18 is lined with lengths of casing 20. The wellbore 12 can be drilled in stages, and the casing 20 may be installed between stages.

The depicted well system 10 is a vertical well, with the wellbore 12 extending substantially vertically from the surface 16 to the subterranean zone 18. The concepts herein, however, are applicable to many other different configurations of wells, including horizontal, slanted or otherwise deviated wells, and multilateral wells with legs deviating from an entry well. A drill string 22 is shown as having been lowered from the surface 16 into the wellbore 12. The drill string 22 may be a series of jointed lengths of drill pipe coupled together end-to-end. The drill string 22 includes one or more well tools, including a wellbore reamer tool 24 and a drill bit 26. The drill bit 26 is rotated by rotating the drill string 22 at the surface 16. With weight applied by the drill string 22, the rotating drill bit 26 engages the formation and forms the wellbore 12 toward a target zone. During the drilling process, drilling fluids are circulated to clean the cuttings while the drill bit 26 is advanced through the formation. As the drill string 22 and the drill bit 26 are rotated, the wellbore reamer tool 24 cuts away the formation, this process is known as "reaming while drilling". The formation cuttings mix with and are suspended within the drilling fluid and pass up through an annular space 118 between the wall of the wellbore 12 and the outer surface of the drill string 22 to the surface 16.

Figure 2:
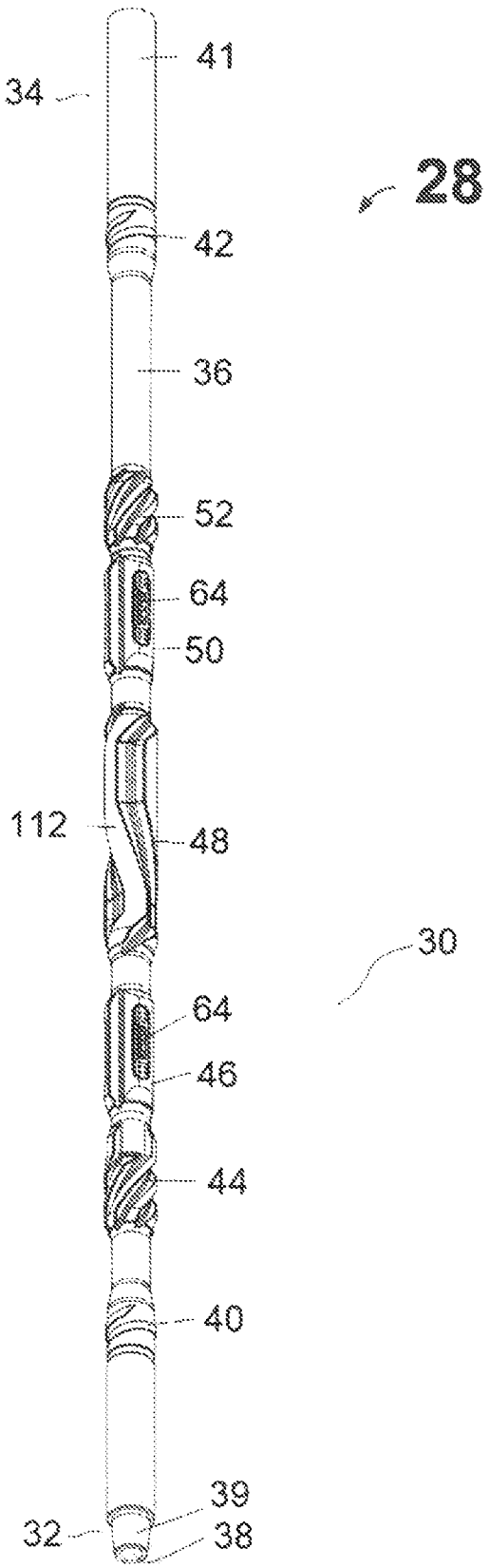
FIG. 2 is a perspective view of one embodiment of a wellbore reamer tool of the present invention.
Figure 3:
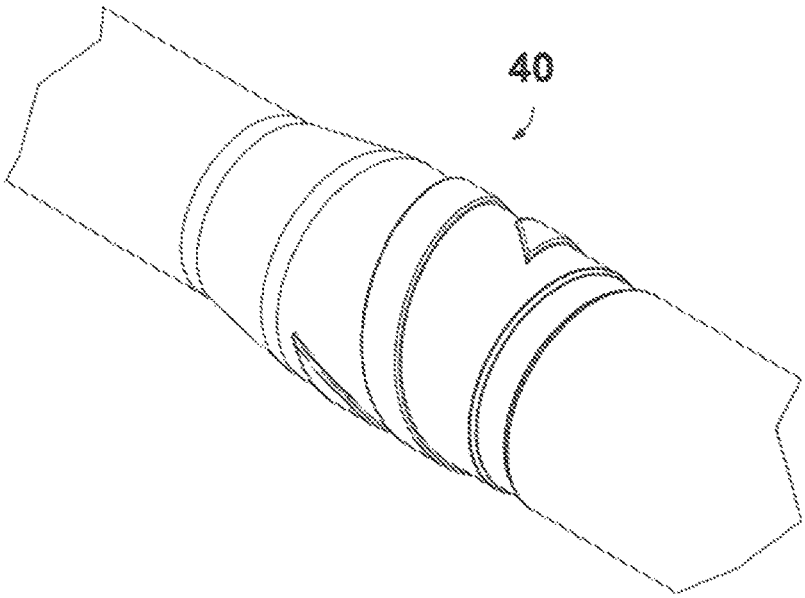
FIG. 3 is a schematic perspective view of downhole spiral hardbands of the wellbore reamer tool of FIG. 2.

FIG. 2 is a perspective view of an exemplary wellbore reamer tool 28 that can be used as the wellbore reamer tool 24 of FIG. 1 (PRIOR ART). The reamer tool 28 is carried on the drill string 22. The reamer tool 28 is shown generally to comprise an elongated substantially cylindrical body 30 having a downhole end 32, an uphole end 34, a tool neck 36, and defining a central bore 38 extending therethrough. In some embodiments, the reamer tool 28 is coupled to other tools of the bottom hole assembly or another drill pipe at the downhole end 32 by a threaded pin connection 39. In some embodiments, the reamer tool 28 is coupled to the drill string 22 by a threaded box connection 41 at the uphole end 34. Downhole and uphole spiral hardbands 40, 42 are positioned on the downhole and uphole ends 32, 34 respectively (FIGS. 2 and 3). In some embodiments, the downhole and uphole spiral hardbands 40, 42 are formed from tungsten carbide or diamond. The downhole and uphole spiral hardbands 40, 42 provide erosion protection at the downhole and uphole ends 32, 34 of the reamer tool 28.

The reamer tool 28 includes a central axis A-A which defines a central longitudinal axis along the length of and through the center of the reamer tool 28 (e.g., through the center of the body 30). During drilling operations, the reamer tool 28 is rotated about the central axis A-A and moved up and/or down while rotating to enlarge the diameter of the wellbore previously drilled by the drill bit 26. The central axis A-A may define a rotational axis of the reamer tool 28, for example, during operation of the reamer tool 28.

In some embodiments, the reamer tool 28 comprises downhole spiral hardbands 40, a first helical impeller 44, first cutting portions 46, an integral blade stabilizer 48, second cutting portions 50, a second helical impeller 52, and uphole spiral hardbands 42. In some embodiments as shown in FIG. 2, the reamer tool 28 comprises in sequence, from the downhole end 32 to the uphole end 34, downhole spiral hardbands 40, a first helical impeller 44, first cutting portions 46, an integral blade stabilizer 48, second cutting portions 50, a second helical impeller 52, and uphole spiral hardbands 42.

First Helical Impeller

As used herein, the term "helical" means being in the shape of a helix or a curve that goes around a central tube or cone shape in the form of a spiral. As shown in FIG. 2, the first helical impeller 44 is positioned downhole proximate the downhole end 32 of the reamer tool 28. In some embodiments, the first helical impeller 44 is positioned downhole proximate the downhole end 32 of the reamer tool 28 between the downhole spiral hardbands 40 and the first cutting portions 46.

Figure 4:
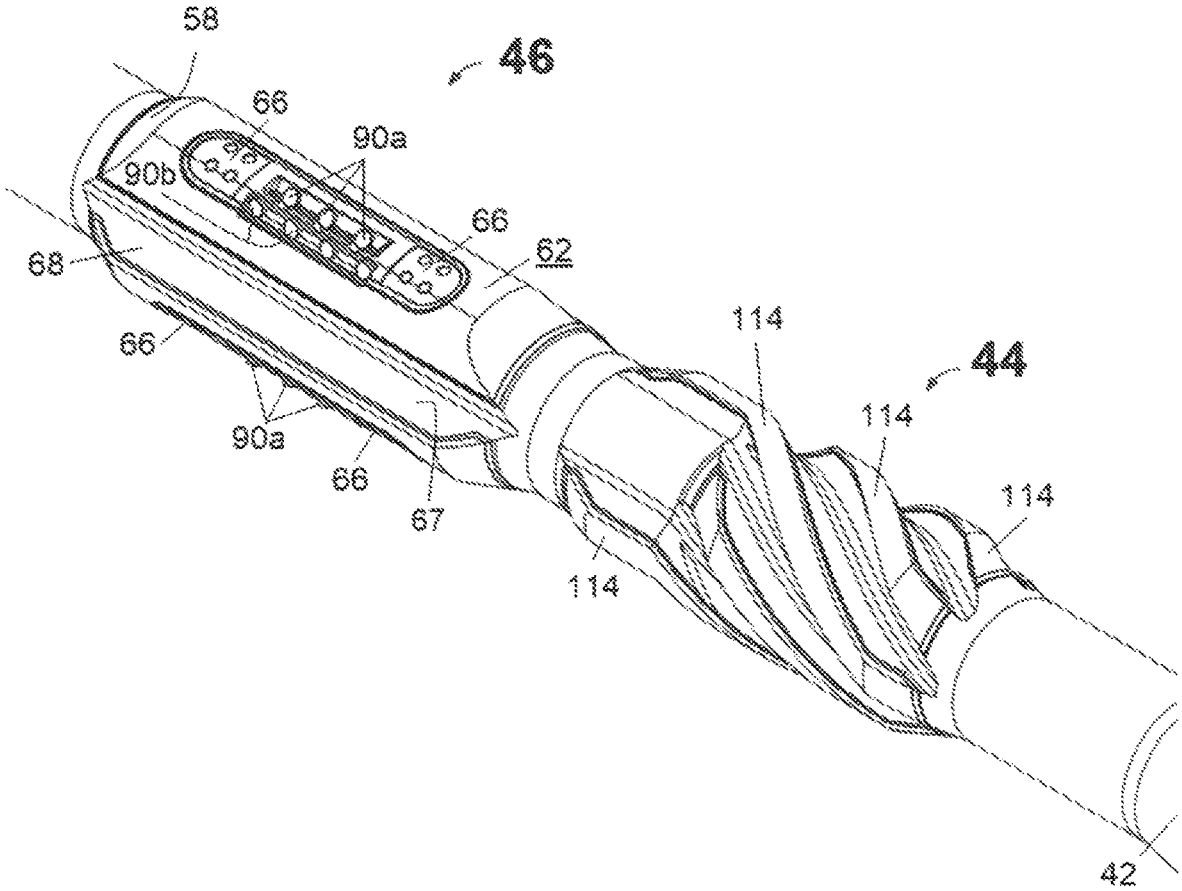
FIG. 4 is a schematic perspective view of a first helical impeller and a first cutting portion of the wellbore reamer tool of FIG. 2.
Figure 5:
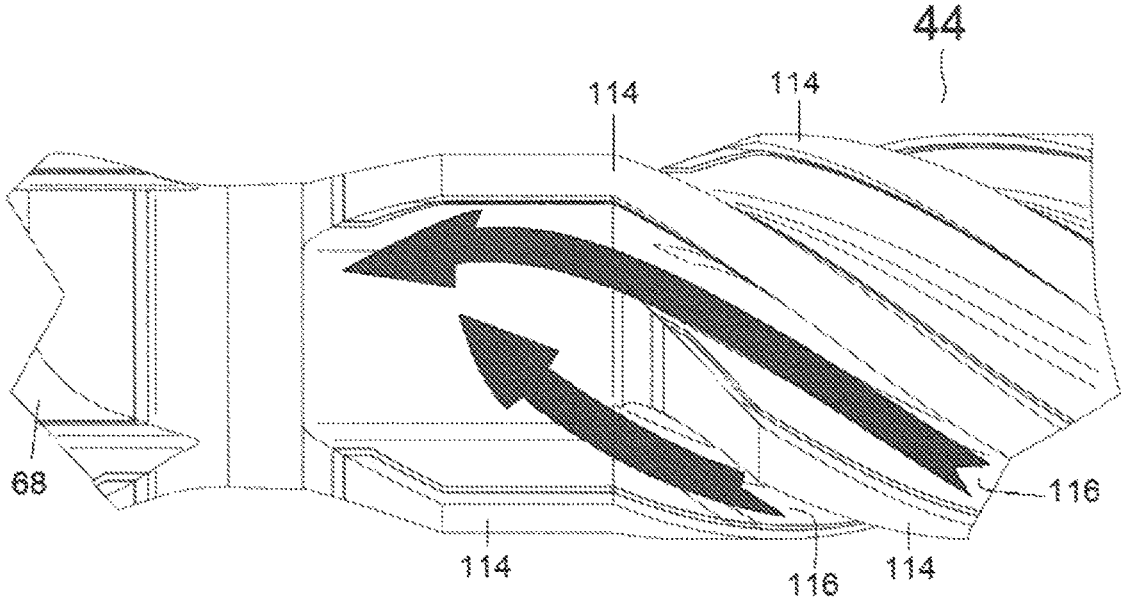
FIG. 5 is perspective view of a portion of the first helical impeller of FIG. 4, with arrows representing the flow of cuttings within helical grooves defined by odd and even helical blades of the first helical impeller.
Figure 6:
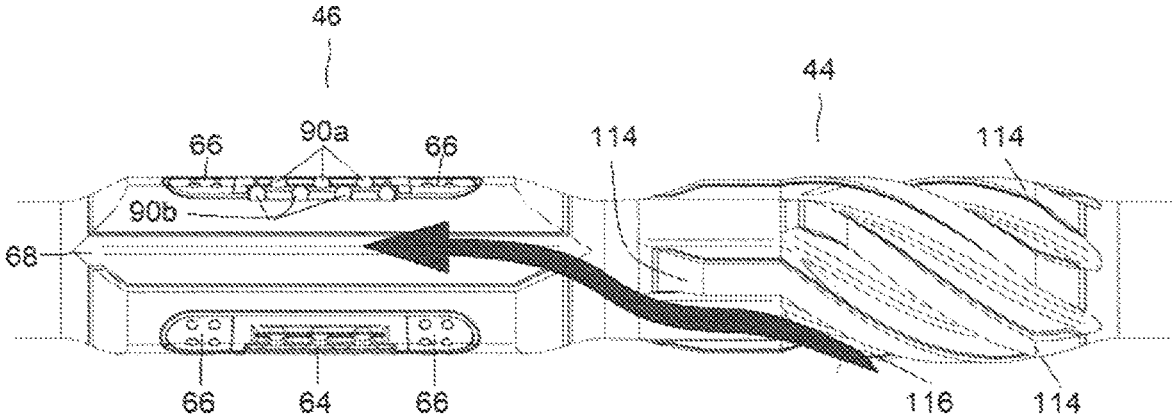
FIG. 6 is a perspective view of the first cutting portions and the first helical impeller of FIG. 4, with an arrow representing the combined flow of cuttings from the first helical impeller being directed uphole towards the first cutting portion.

In some embodiments, the first helical impeller 44 comprises a plurality of odd and even helical blades 114 (FIG. 4). In some embodiments, the first helical impeller 44 comprises six helical blades including three odd blades (i.e., designated as blades "1, 3, and 5") and three even blades (i.e., designated as blades "2, 4 and 6"). The odd blades end before the even blades. The even blades comprise straight-edged extension blades to direct the cuttings to a desired position between blades 68 in the first cutting portions 46. In some embodiments, a helical groove 116 is defined between each adjacent helical blade 114 to allow the flow of the cuttings therethrough. The helical groove 116 ending at the end of each odd blade allows the flow of the cuttings in the uphole direction. As shown in FIG. 5, the flow of the cuttings within the helical grooves 116 is directed by the odd and even blades 114. The helical grooves 116 ending at the ends of the odd blades allow flow in the uphole direction (indicated by the short arrow). This flow combines with the flow directed by the even blades (indicated by the long arrow). As shown in FIG. 6, the straight edged extension blades 114 direct the combined flow of the cuttings in the uphole direction (indicated by the single arrow) towards the grooves 67 between the blades 68 of the first cutting portions 46.

The first helical impeller 44 is configured or sized to ensure that the helical blades 114 do not directly contact the wall of the wellbore 12. In some embodiments, the first helical impeller 44 has an outer diameter which is smaller than the diameter of the wellbore 12. Having a smaller outer diameter than the diameter of the wellbore 12 allows the first helical impeller 44 to rotate freely without the helical blades 114 impacting and potentially damaging the wall of the wellbore 12. By sizing the first helical impeller 44 in this manner, sufficient clearance space may be provided between the helical blades 114 and the wall of the wellbore 12 to ensure the generation of sufficient turbulence and subsequent controlled flow while removing the cuttings. The first helical impeller 44 functions to increase the flow velocity of existing and newly generated cuttings from downhole, directing them uphole within the wellbore 12 to the surface 16. The first helical impeller 44 thus "cleans" the wellbore 12 in advance of the reaming to be performed by the first and second cutting portions 46, 50. As the reamer tool 28 is advanced further downhole, the first and second cutting portions 46, 50 ream on the cleaned wellbore 12.

First Cutting Portion and Second Cutting Portion

Figure 18:
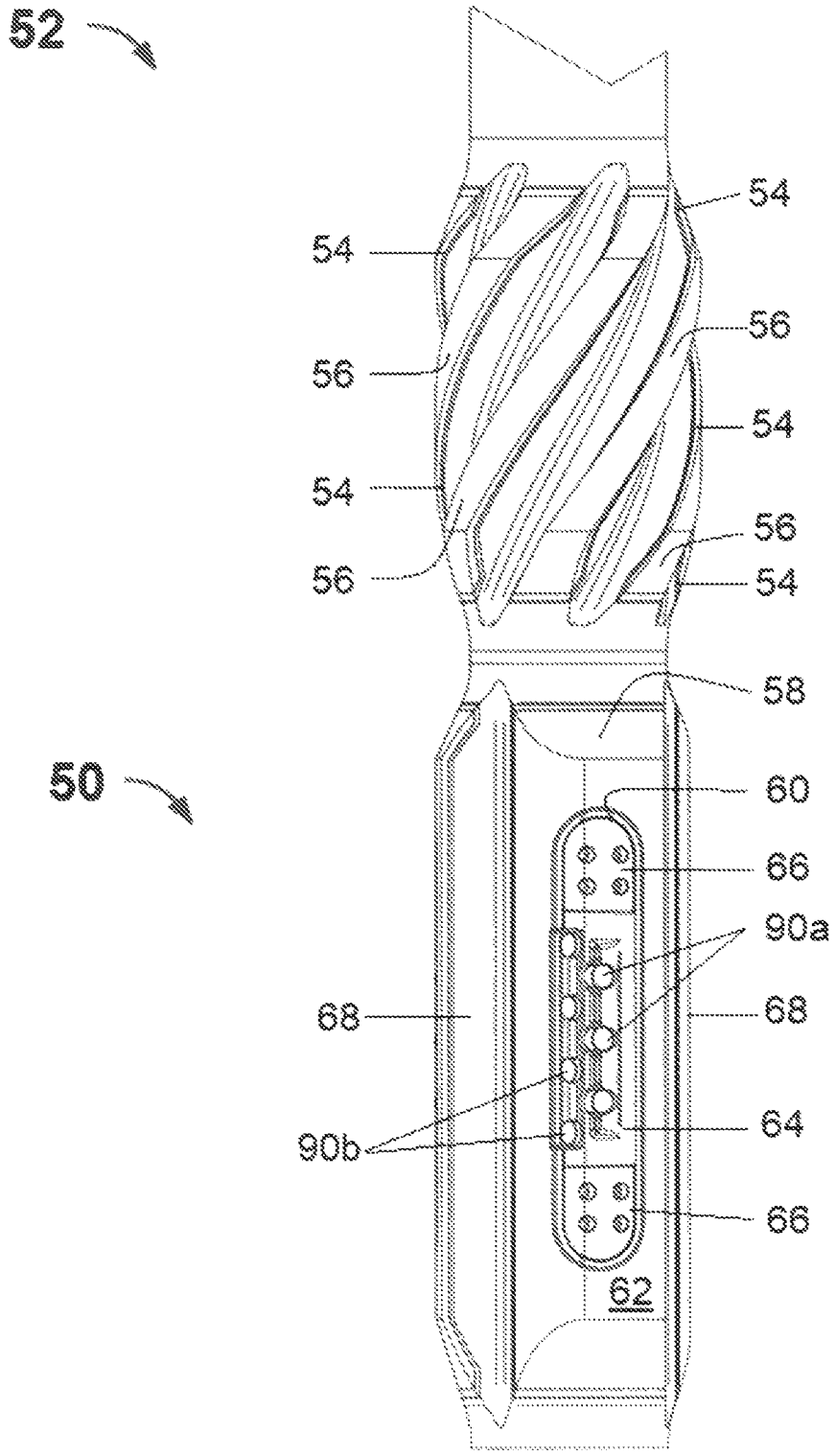
FIG. 18 is a perspective view of second cutting portions and a second helical impeller of the wellbore reamer tool of FIG. 2.

The reamer tool 28 comprises first cutting portions 46 and second cutting portions 50. In some embodiments, the first cutting portions 46 are positioned downhole proximate the downhole end 32 of the reamer tool 28 and between the first helical impeller 44 and the integral blade stabilizer 48 (FIGS. 2 and 4). In some embodiments, the second cutting portions 50 are positioned uphole proximate the uphole end 34 of the reamer tool 28 between the integral blade stabilizer 48 and the second helical impeller 52 (FIGS. 2 and 18).

In some embodiments, each of the first and second cutting portions 46, 50 comprises a bladed portion 58 defining a plurality of pockets 60 formed in the face 62 of the bladed portion 58 and configured to radially receive and accommodate cutter inserts 64 and wedge retainers 66 (FIGS. 7-10). In some embodiments, the face 62 of the bladed portion 58 is formed of tungsten carbide. In some embodiments, the bladed portion 58 comprises three pockets 60. In some embodiments, the bladed portion 58 comprises a plurality of blades 68 spaced evenly and radially around the bladed portion 58 about the central axis A-A. In some embodiments, the blades 68 are substantially straight-edged and extend axially. In some embodiments, the bladed portion 58 comprises three blades 68.

Figure 7:
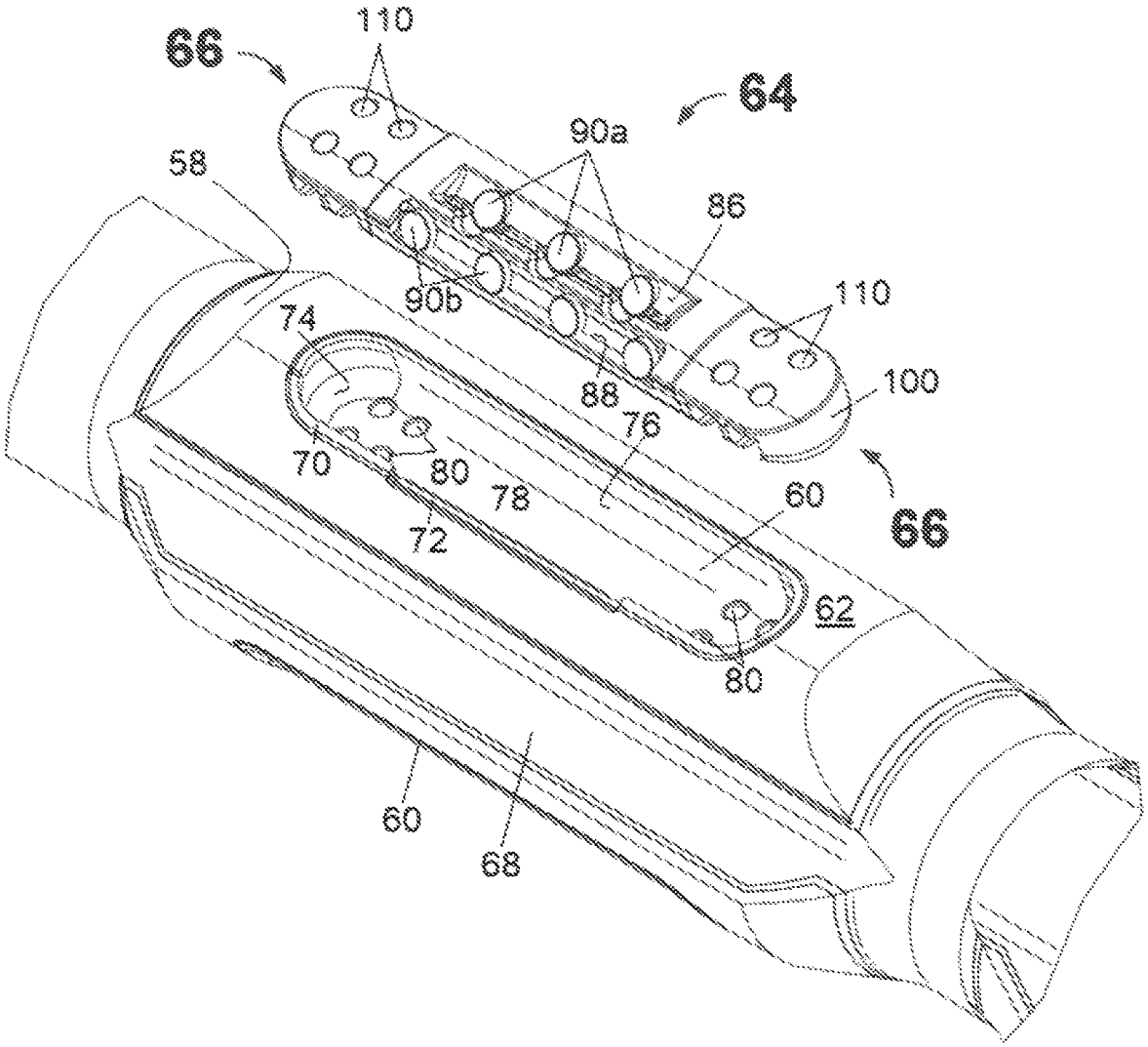
FIG. 7 is a perspective view of the first cutting portions of the wellbore reamer tool of FIG. 2, showing the cutting insert before assembly into the first cutting portions.
Figure 8:
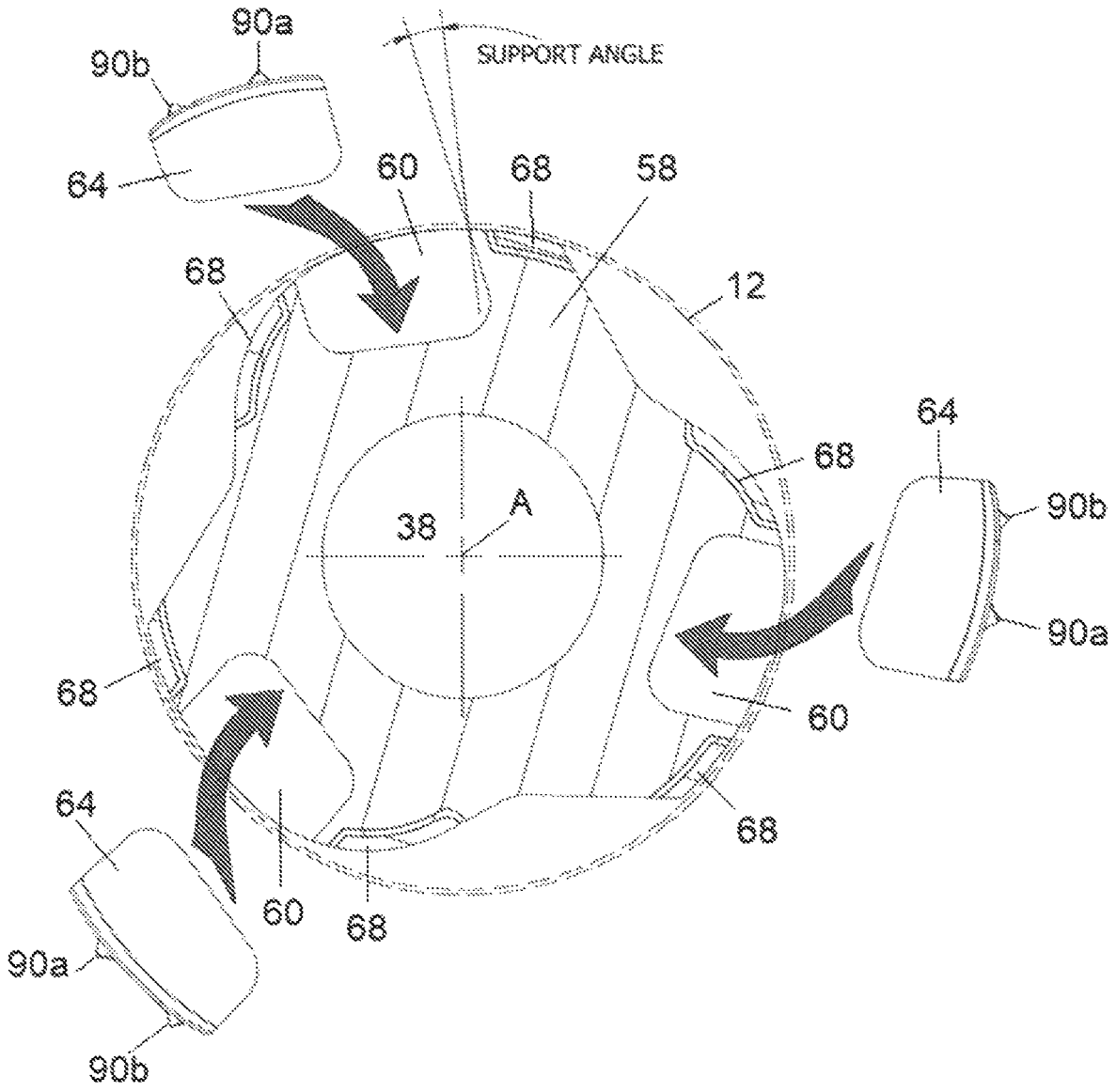
FIG. 8 is a cross-sectional transverse view of the first cutting portions of FIG. 7 before assembly of three cutting inserts, and the wellbore wall shown in phantom.

In some embodiments, the pockets 60 are spaced evenly and radially around the bladed portion 58 about the central axis A-A, and positioned in between the blades 68 (FIG. 8). In some embodiments, there are three pockets 60. In some embodiments, the pockets 60 on the first and second cutting portions 46, 50 are oriented in different axial positions in the blades 68. In some embodiments, each pocket 60 is in the shape of a geometric stadium, namely a rectangle having a pair of semi-circles positioned at opposite ends. In some embodiments, the pocket 60 comprises a rim 70 defining a notch 72, opposed end walls 74, opposed side walls 76, and a base 78 upon which the cutter insert 64 is seated (FIG. 7). In some embodiments, the length of the notch 72 is the same or similar to the length of the inner row of the cutters 90*b*. In some embodiments, the opposed end walls 74 are curved. In some embodiments, the opposed side walls 76 are straight. It will be appreciated by those skilled in the art that other shapes such as for example, rectangular, square, oval, and the like, are included within the scope of the invention. In some embodiments, the base 78 defines one or more apertures 80 for receiving attachment means 82 therethrough to fixedly attach one or more wedge retainers 66 to the bladed portion 58, thereby securing and retaining the cutter insert 64 within the pocket 60.

Figure 10:
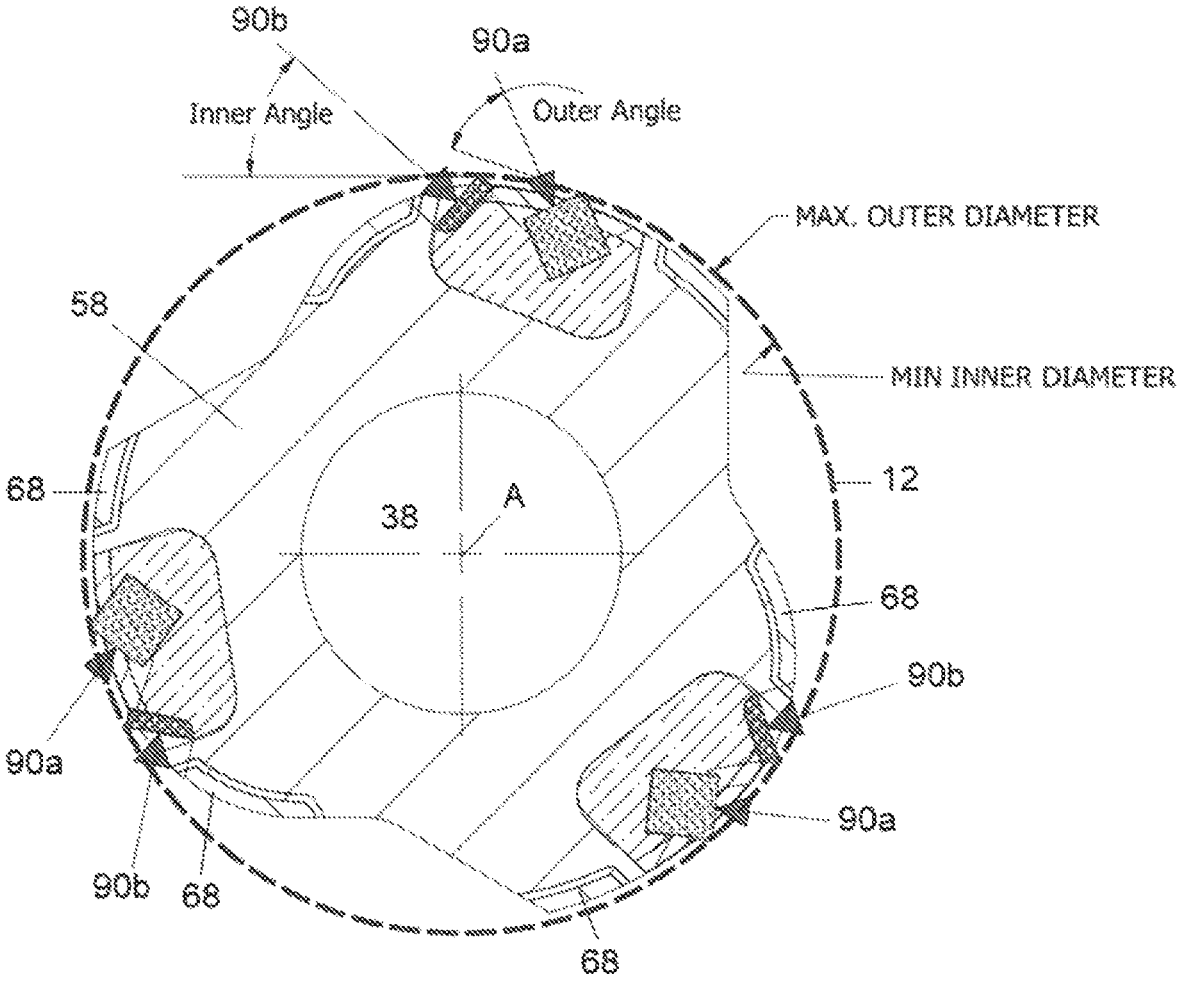
FIG. 10 is a cross-sectional transverse view of the first cutting portions of FIG. 9 with three cutting inserts assembled into the first cutting portions, and the wellbore wall shown in phantom.

It is contemplated that the number, size, shape, and positioning of the pockets 60 and blades 68 may vary. Such factors may be dictated for example, by the dimensions of the blade portion 58, and the corresponding number and dimensions of the cutter inserts 64. The cutter inserts 64 can be readily inserted or detached from the corresponding pockets 60 for inspection, reinsertion, repair, or replacement if necessary. In some embodiments, the cutter inserts 64 are positioned within the pockets 60 so as to be spaced evenly and radially around the bladed portion 58 about the central axis A-A, and positioned in between the blades 68 (FIG. 10).

Figure 11:
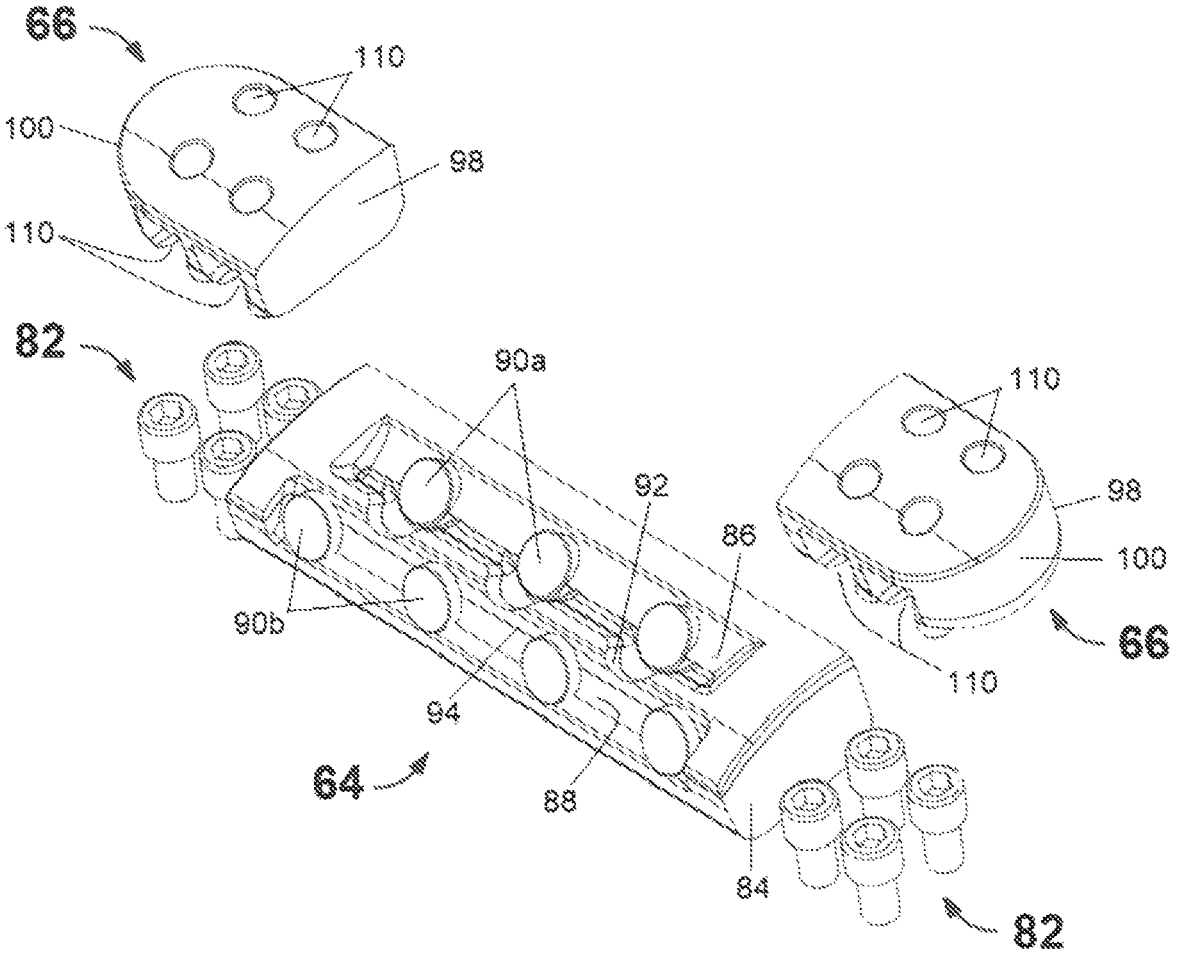
FIG. 11 is an exploded perspective view of a radially insertable cutting insert including inner and outer rows of cutters, a pair of wedge retainers, and attachment means.

As shown in FIG. 11, each cutter insert 64 comprises a cutter insert body 84 defining a first recess 86 and a second recess 88. Each recess 86, 88 is configured for receiving a plurality of cutters 90*a*, 90*b* arranged linearly in rows and inclined at a predetermined attacking angle (FIGS. 12-15). The attacking angle is selected so as to ensure that the cutters 90*a*, 90*b* may remove cuttings from the wall of the wellbore 12 in a precise amount on each radial step and that the torque while reaming may be minimized.

In some embodiments, at least two rows representing "outer" and "inner" rows of cutters 90*a*, 90*b* are arranged linearly within the cutter insert 64. In some embodiments, the inner row of cutters 90*b* is arranged linearly within the first recess 88. In some embodiments, the outer row of cutters 90*a* is arranged linearly within the second recess 86. In some embodiments, the outer row has fewer cutters 90*a* compared to the number of cutters 90*b* in the inner row. In some embodiments, the outer row comprises three cutters 90*a* in the first recess 86. In some embodiments, the inner row comprises four cutters 90*b* in the second recess 88.

Figure 12:
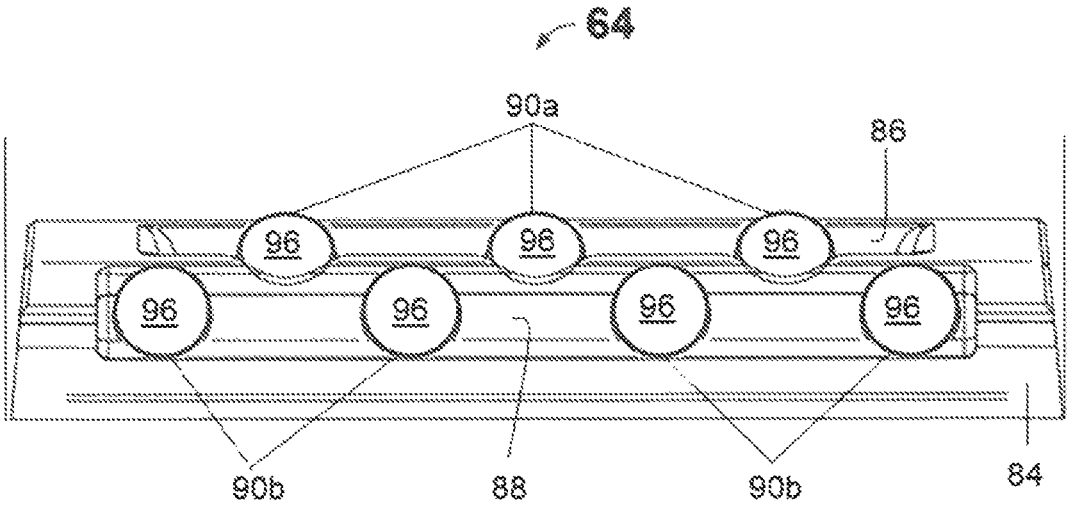
FIG. 12 is a front perspective view of a cutter insert showing inner and outer rows of cutters.
Figure 13:
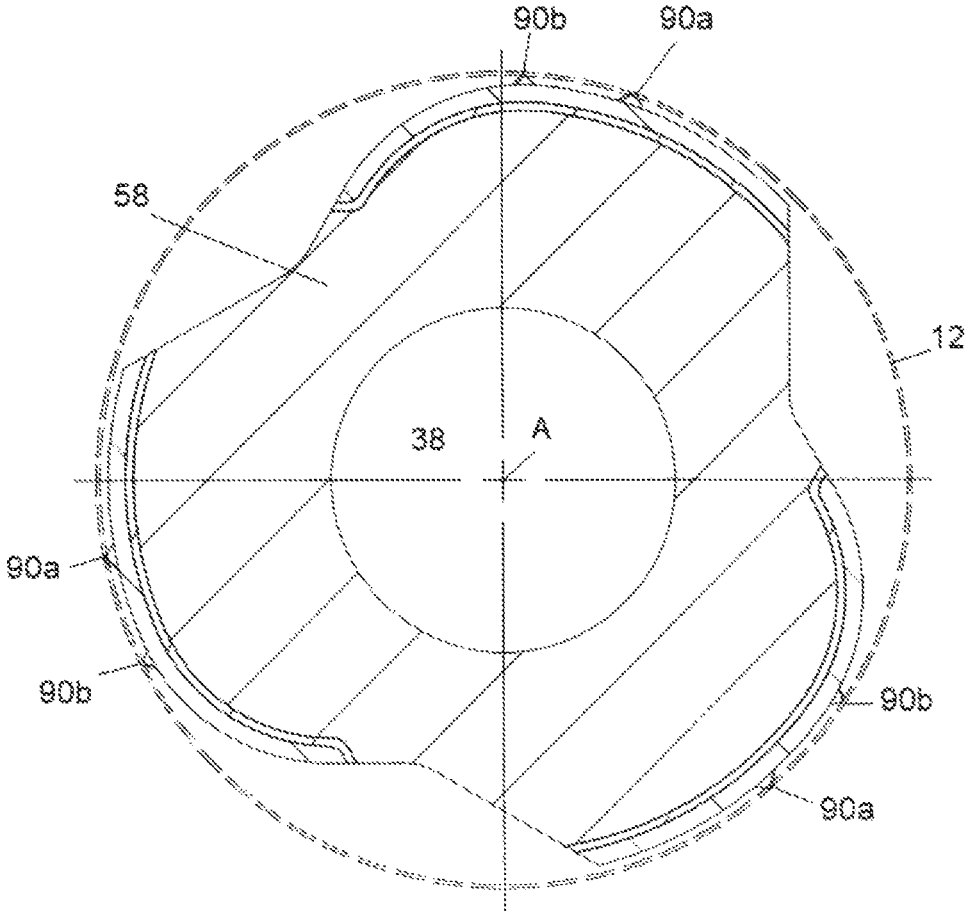
FIG. 13 is a cross-sectional transverse view of the cutting portions, showing the positioning of the inner and outer rows of cutters of FIG. 12 in relation to the body of the cutting portions, and the wellbore wall shown in phantom.

In some embodiments, each recess 86, 88 is substantially rectangular-shaped. In some embodiments, the first and second recesses 86, 88 are aligned substantially parallel to each other, with the second recess 88 being positioned "below" the first recess 86 (FIGS. 12 and 13). In some embodiments, the first recess 86 has a length shorter than the length of the second recess 88 to accommodate fewer cutters 90*a*. In some embodiments, the first recess 86 includes a partially scalloped edge 92 which defines clearance spaces to accommodate the incline of each individual cutter 90*a*. In some embodiments, the second recess 88 has a substantially straight edge 94 facing the partially scalloped edge 92 of the first recess 86. The cutters 90*a* are evenly spaced apart in the first recess 86 to be positioned in an alternating fashion with the cutters 90*b* also evenly spaced apart in the second recess 88. The cutters 90*a*, 90*b* are thereby balanced to ream with a minimum torque.

The cutters 90*a*, 90*b* are fabricated to combine both toughness and hardness in order to prevent them from failing under normal forces of use for long life. In some embodiments, the cutters 90*a*, 90*b* are represented as a disk-shaped (FIGS. 11 and 12). In some embodiments, the cutters 90*a* are represented as square-shaped when viewed in cross-section (FIG. 10). In some embodiments, the cutters 90*b* are represented as rectangular-shaped with a single rounded corner when viewed in cross-section (FIG. 10). A cutting surface 96 comprising a hard, super-abrasive material, such as mutually bound particles of polycrystalline diamond forming a so-called "diamond table," may be provided on a substantially circular end surface of a substrate of each cutter 90*a*, 90*b*. Suitable substrates include, but are not limited to, hard metallic materials such as tungsten carbide. Such cutters 90*a*, 90*b* are often referred to as "polycrystalline diamond compact" (PDC) cutters. The PDC cutters 90*a*, 90*b* are fabricated separately from the cutter insert body 84 and secured by their substrates within the first and second recesses 86, 88 by brazing or welding.

In some embodiments, the cutter insert 64 is securely mounted or retained within the pocket 60 by fixedly attaching one or more wedge retainers 66 to the bladed portion 58. In some embodiments, a wedge retainer 66 is positioned at each end of the cutter insert body 84 (FIGS. 4, 7, 9, 11, and 18). In some embodiments, the wedge retainer 66 comprises a substantially square-shaped wedge body 98 having a curved edge 100 (FIG. 11). The wedge retainer 66 defines corresponding openings 110 extending through the wedge body 98 which align with the apertures 80 in the base 78 of the pocket 60. In some embodiments, the wedge retainer 66 defines four openings 110 evenly spaced in a square-like configuration. The openings 110 of the wedge retainer 66 are configured to receive, accommodate, and allow the passage of attachment means therethrough. Suitable attachment means 82 include, but are not limited to, bolts, screws, and the like. In some embodiments, the attachment means 82 are bolts. In such a configuration, the cutter insert 64 may be removably secured within the pocket 60 to facilitate relatively easy removal, inspection, repair, and replacement of components of the cutter insert 64 if damaged. The wedge retainer 66 may be made of any suitable hard material including, but not limited to, steel, or steel alloy. The bolts 82 may be made of steel alloy.

Figure 9:
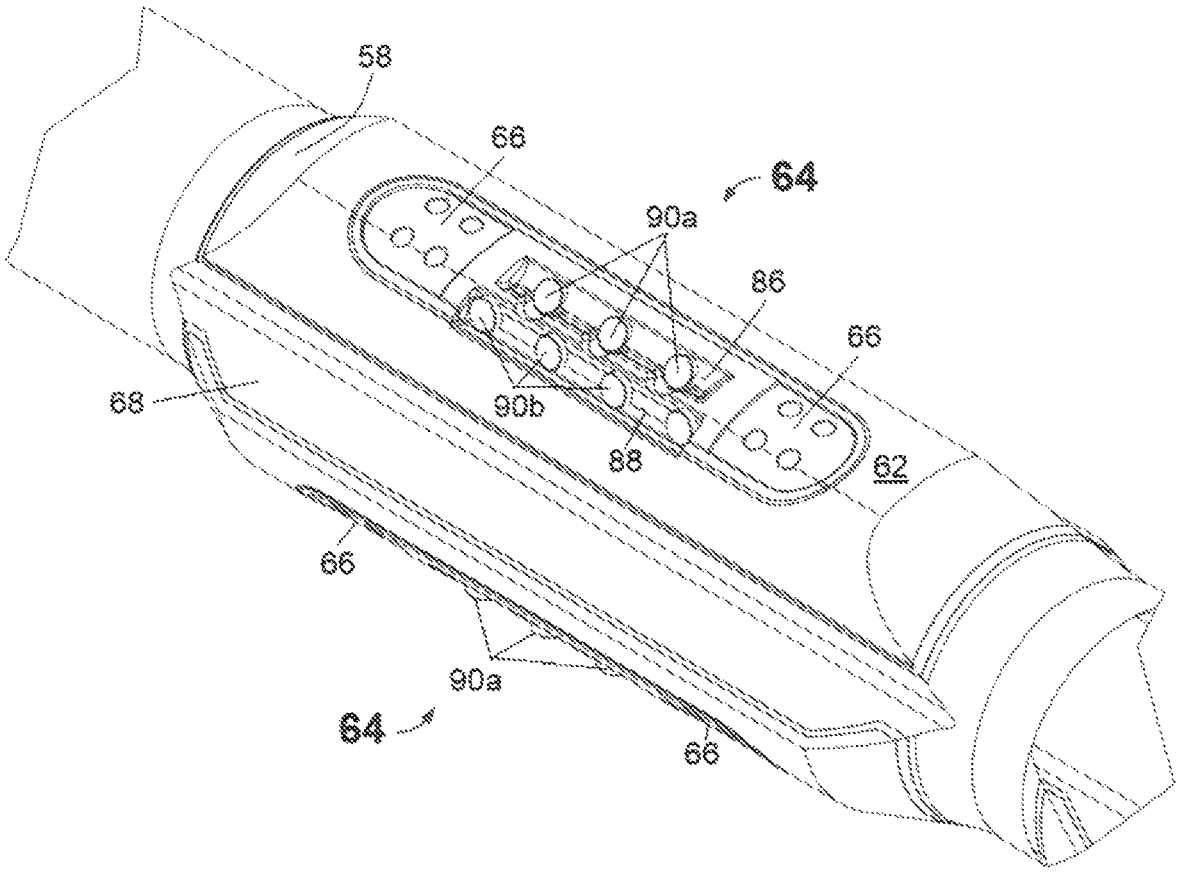
FIG. 9 is a perspective view of the first cutting portions of the wellbore reamer tool of FIG. 2, showing the cutting inserts assembled into the first cutting portions.

As shown in FIGS. 7-9, the cutter insert 64 and wedge retainers 66 are installed into the pocket 60 by placing a wedge retainer 66 at each end of the cutter insert 64, and aligning the inner row of the cutters 90*b* with the notch 72 of the pocket 60. The notch 72 has the same or similar length as the length of the inner row of the cutters 90*b* in order to define a clearance space to accommodate the incline of each individual cutter 90*b*. The cutter insert 64 is seated on the base 78 of the pocket 60, and the curved edges 100 of the wedge retainers 66 seat against the curved opposed end walls 74 of the pocket 60. The cutter insert 64 and wedge retainers 66 lie flush with the face 62 of the base portion 58, with the cutters 90*a*, 90*b* protruding above the rim 70 and notch 72 of the pocket 60 (FIGS. 9 and 10). The attachment means 82 extend through the openings 110 of the wedge retainers 66 and the apertures 80 of the pocket 60 to securely mount and retain the cutter insert 64 to the blade portion 58 during use.

The first and second cutting portions 46, 50 are strategically positioned and spaced apart at a predetermined distance in order to provide multiple pockets 60 and to allow flexibility for the positioning of any desired number of cutter inserts 64 along the length of the reamer tool 28 as needed (FIG. 2). The multiple pockets 60 are positioned circumferentially and axially in both the uphole and downhole positions in order to allow more coverage from the cutters 90*a*, 90*b* in one single rotation. In some embodiments, six pockets 60 supporting six cutter inserts 64 providing multiple inner and outer rows of cutters 90*a*, 90*b* are present on the reamer tool 28 (FIG. 2). In such a configuration, substantial reaming capability can be achieved by the attacking angle of such multiple rows of cutters 90*a*, 90*b* to cut or ream the precise amount of cuttings from the wall of the wellbore 12 on each radial step to guarantee lower torque while reaming (FIG. 10).

Figure 14:
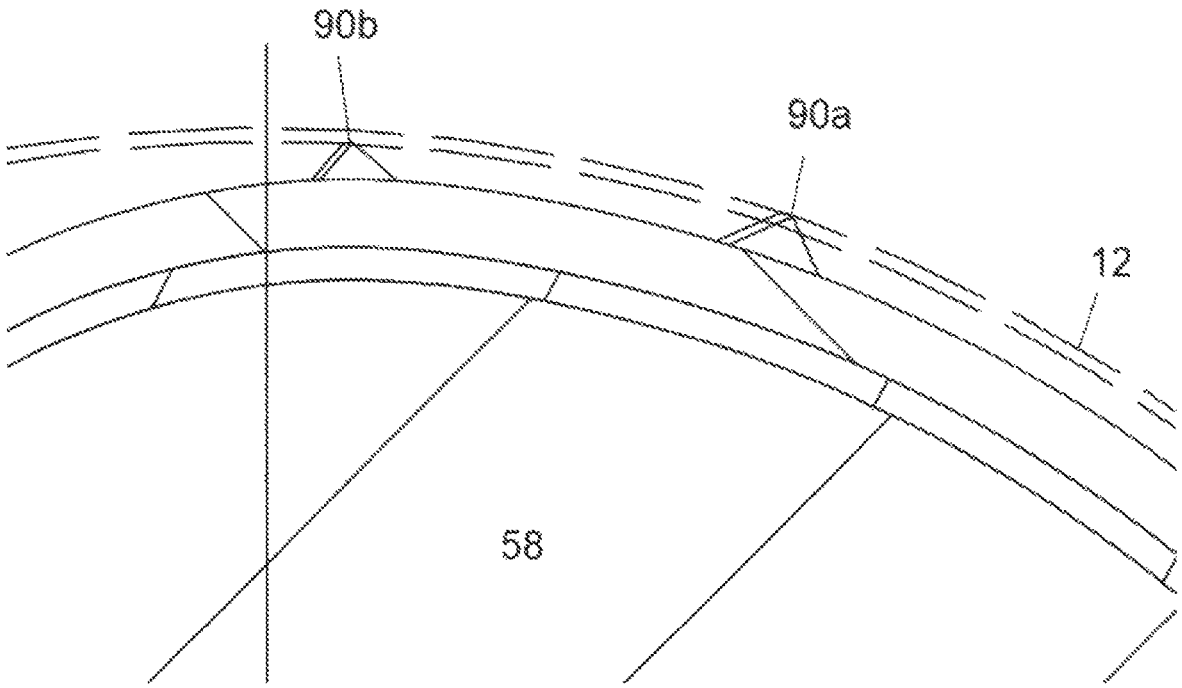
FIG. 14 is an exploded cross-sectional transverse view of a cutting portion of FIG. 13, showing the working diameter for the inner and outer rows of cutters and the wellbore wall shown in phantom.

Without being bound by any theory, the multiple rows of cutters 90*a*, 90*b* may help to maintain the mechanical integrity of the outer cutters 90*a* by reaming smaller diameters predominantly with the internal cutters 90*b*. This may allow sliding drilling without adding drag or increasing friction since the integrity of the outer cutters 90*a* may be less compromised. As used herein, the term "slide drilling" means drilling by rotating the drill bit downhole without rotating the drill string from the surface. Slide drilling is commonly used to build and control or correct hole angle in directional drilling operations. Without turning the drill string, the drill bit is rotated and drills in the direction it points. By controlling the amount of hole drilled in the sliding versus the rotating mode, the wellbore trajectory can be precisely controlled. The outer and inner rows of cutters 90*a*, 90*b* are placed into a predetermined radial position to allow a progressive reaming during rotation, meaning that the maximum diameter which the inner cutters 90*b* can reach is smaller than the maximum diameter which the outer cutters 90*a* can reach (FIGS. 12-14).

Figure 15:
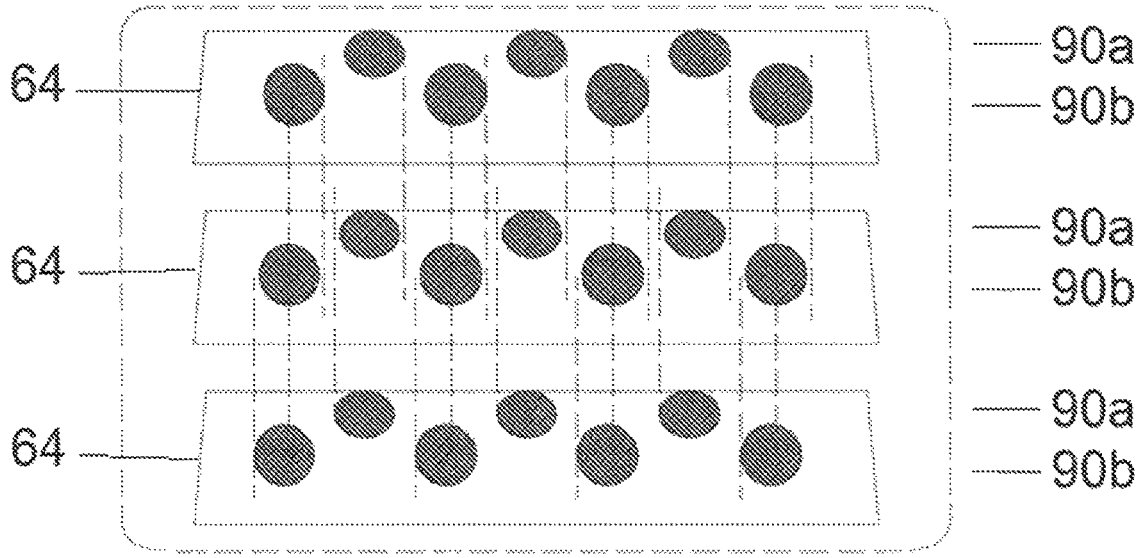
FIG. 15 is a schematic representation of axial displacement of the cutting inserts in the cutting portions of FIG. 13 for progressive exposure of the reaming surfaces.

FIG. 15 shows the axial displacement of the cutting inserts 64 for progressive exposure of the reaming surfaces. All three pockets 60 holding the cutting inserts 64 at the same downhole and uphole positions have an axial displacement between them (indicated by dashed lines), allowing the cutting inserts 64 to sit in an axial position where the cutters 90*a*, 90*b* are not aligned. As the reamer tool 28 rotates and moves in the downhole direction during front reaming operations, the trajectory of the cutters 90*a*, 90*b* comprises a helical trajectory. Having multiple axially displaced cutters 90*a*, 90*b* allows more reaming coverage as every axial position creates a new helical trajectory. Such axial displacement of the cutting inserts 64 enables coverage of wider areas while shearing the wall of the wellbore 12.

Without being bound by any theory, providing strategically positioned multiple inner and outer rows of cutters 90*b*, 90*a* for reaming the wall of the wellbore 12 may improve wellbore quality which is generally related to the "smoothness" of the wellbore or the "tortuosity." The configuration and positioning of multiple cutters 90*a*, 90*b* along the length of the reamer tool 28 may reduce the micro-tortuosity and high frequency wellbore spiraling, thereby producing a smooth, high-quality, un-spiraled wellbore.

Integral Blade Stabilizer

Figure 16:
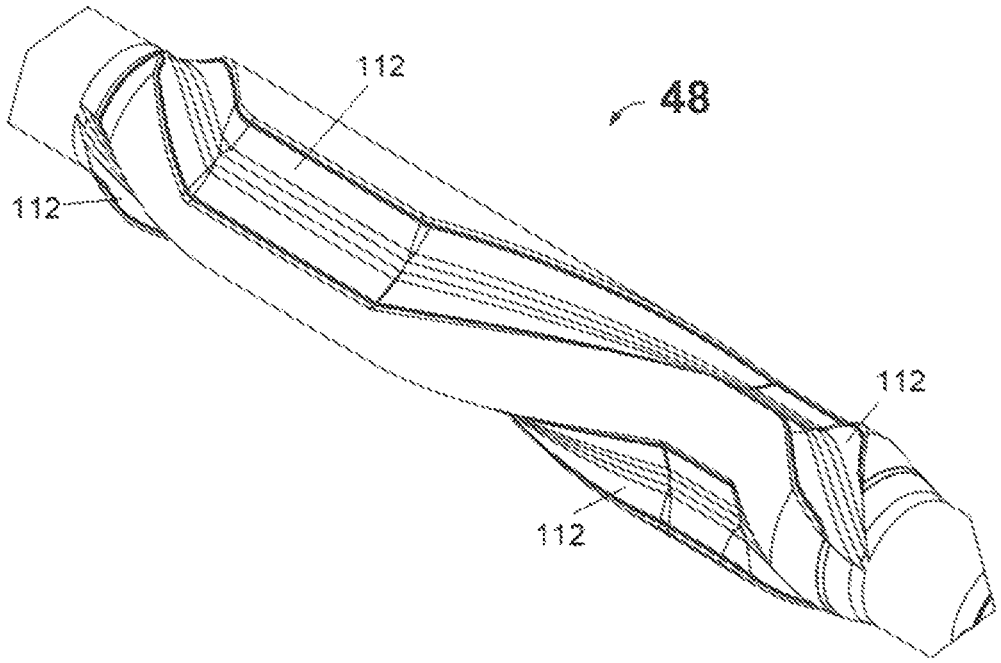
FIG. 16 is a perspective view of an integral blade stabilizer of the wellbore reamer tool of FIG. 2.
Figure 17:
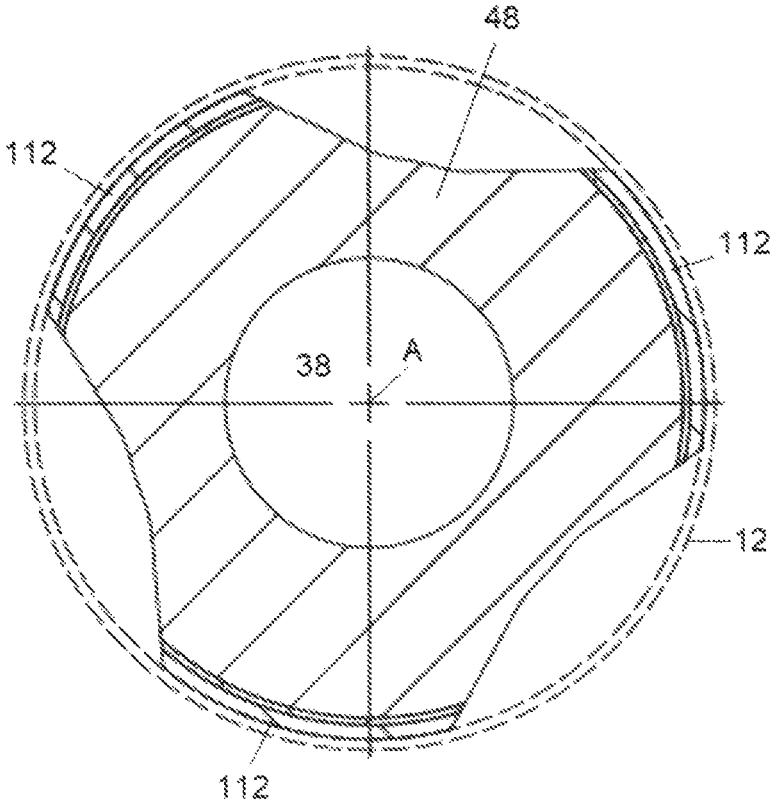
FIG. 17 is a cross-sectional transverse view of the integral blade stabilizer of FIG. 15, showing the working maximum diameter of the stabilizer and the wellbore wall diameter both in phantom.

In some embodiments, the integral blade stabilizer 48 is positioned at an uphole position of the reamer tool 28 between the first cutting portions 46 and the second cutting portions 50. As shown in FIGS. 16 and 17, the integral blade stabilizer 48 comprises a plurality of substantially "S"-shaped stabilizer blades 112. In some embodiments, the integral blade stabilizer 48 comprises three stabilizer blades 112. The length and outer diameter of the integral blade stabilizer 48 provides radial support and tilt support to the reamer tool 28.

Without being bound by any theory, the "S"-shaped stabilizer blades 112 may help to prevent or minimize the sliding or movement of the cuttings in the downhole direction in the event that the flow circulation stops. The "S" shape may also help to reduce friction during slide drilling. In the event of a stabilizer blade 112 sitting on the low side of the wellbore 12 (for example, of horizontal wells), the friction between the stabilizer blade 112 and the wall of the wellbore 12 is minimized since only a partial area of the surface of the stabilizer blade 112 shall contact the wellbore 12 due to the stabilizer blade 112 being "S"-shaped.

In some embodiments, the outer diameter of the integral blade stabilizer 48 is larger than the outer diameter of each of the first and second cutting portions 46, 50. Having a larger outer diameter confers 360° support around the circumference of the reamer tool 28 which may confer stability to the drill string 22, and limits the amount of debris removed by the cutters 90*a*, 90*b* per radial step (FIG. 17).

Second Helical Impeller

As shown in FIG. 2, the second helical impeller 52 is positioned uphole proximate the uphole end 34 of the reamer tool 28. In some embodiments, the second helical impeller 52 is positioned uphole proximate the uphole end 34 of the reamer tool 28 above both the first and second cutting portions 46, 50. In some embodiments, the second helical impeller 52 is positioned uphole proximate the uphole end 34 of the reamer tool 28 between the second cutting portion 50 and the tool neck 36.

In some embodiments, the second helical impeller 52 comprises a plurality of helical blades 56 (FIG. 18). In some embodiments, a helical groove 54 is defined between each adjacent helical blade 56. In some embodiments, the helical blades 56 comprise odd blades and even blades. In some embodiments, the second helical impeller 52 comprises six helical blades including three odd blades (i.e., designated as blades "1, 3, and 5") and three even blades (i.e., designated as blades "2, 4 and 6").

The second helical impeller 52 is configured or sized to ensure that the helical blades 56 do not directly contact the wall of the wellbore 12. In some embodiments, the second helical impeller 52 has an outer diameter which is smaller than the diameter of the wellbore 12. Having a smaller outer diameter than the diameter of the wellbore 12 allows the second helical impeller 52 to rotate freely without the helical blades 56 impacting and potentially damaging the wall of the wellbore 12. By sizing the second helical impeller 52 in this manner, sufficient clearance space may be provided between the helical blades 56 and the wall of the wellbore 12 to ensure the generation of sufficient turbulence and subsequent controlled flow while removing the cuttings. The second helical impeller 52 functions to increase the flow velocity of the newly created cuttings.

Manufacture

In some embodiments, the reamer tool 28 comprises in sequence, from the downhole end 32 to the uphole end 34, downhole spiral hardbands 40, a first helical impeller 44, first cutting portions 46, an integral blade stabilizer 48, second cutting portions 50, a second helical impeller 52, and an uphole spiral hardbands 42. During manufacture, the reamer tool 28 may be configured as one integral piece or as separate pieces which are interconnected together to define the unitary central bore 38 extending through the reamer tool 28. The cutter inserts 64, cutters 90*a*, 90*b*, wedge retainers 66, and attachments means 82 are preferably manufactured separately for assembly into the pockets 60 of the bladed portions 58. The cutter inserts 64 can then be readily connected or detached from the pockets 60 for inspection, reinsertion, repair, or replacement if necessary.

The reamer tool 28 can be constructed from any material or combination of materials having suitable properties such as, for example, mechanical strength, ability to withstand cold and adverse field conditions, corrosion resistance, and ease of machining. Suitable materials include, for example, steel alloy, high strength alloy steel, stainless steel, synthetic diamond materials, tungsten carbide, or other appropriate materials known to those skilled in the art.

In some embodiments, the first helical impeller 44, the first cutting portions 46, the integral blade stabilizer 48, the second cutting portions 50, and the second helical impeller 52 are covered by a harder material to protect the reamer tool 28 from erosion due to the constant interaction with the wellbore surface. Suitable materials include, but are not limited to, synthetic diamond and tungsten carbide.

In some embodiments, the downhole spiral hardbands 40 and the uphole spiral hardbands 42 are made from harder materials to protect the downhole end 32 and the uphole end 34 from erosion due to the constant interaction with the wellbore surface. Suitable materials include, but are not limited to, synthetic diamond and tungsten carbide.

Operation

The operation of drilling a wellbore is commonly known to those skilled in the art and will not be discussed in detail. A typical well system 10 was previously described herein (FIG. 1, PRIOR ART). Prior to operation, the completely assembled reamer tool 28 is coupled into the drill string 22 to become integral to the drill string 22, for example, such that the reamer tool 28 is positioned on the drill string 22 as part of the drill string 22.

The drill bit 26 is rotated by rotating the drill string 22 at the surface 16. With weight applied by the drill string 22, the rotating drill bit 26 engages the formation and forms a borehole toward a target zone, generating cuttings as the drill bit 26 is advanced through the formation. Drilling fluids are circulated to clean the cuttings. The reamer tool 28 including all its components is rotated concurrently with the rotating drill string 22. During rotation, the first helical impeller 44 increases the flow velocity of the existing cuttings which are deposited or accumulate as the drill bit 26 is advancing through the formation, and places such cuttings back into circulation to a specific position between the blades 68 of the first cutting portions 46 (FIG. 6). The first helical impeller 44 thus "cleans" the borehole in advance of the reaming to be performed by the first and second cutting portions 46, 50. The second helical impeller 52 increases the flow velocity of the newly incorporated cuttings through the annular 118 towards the surface 16.

To ream the radial wall of the wellbore 12, the cutters 90*a*, 90*b* of the first cutting portions 46 shear against the wall of the wellbore 12, with the inner rows of cutters 90*b* engaging or contacting the wall of the wellbore 12 followed by the outer rows of cutters 90*a* to enlarge the diameter of the wellbore 12 during rotation of the reamer tool 28 about central axis A-A. The newly generated formation cuttings are mixed into the cuttings stream to be suspended within the drilling fluid and the flow is directed uphole.

Similarly, the cutters 90*a*, 90*b* of the second cutting portions 50 shear against the wall of the wellbore 12, with the inner rows of cutters 90*b* contacting the wall followed by the outer rows of cutters 90*a* to enlarge the diameter of the wellbore 12 during rotation of the reamer tool 28 about central axis A-A. The newly generated formation cuttings are mixed into the cuttings stream to be suspended within the drilling fluid and the flow is directed uphole by rotation of the second helical impeller 52. The cuttings stream passes up through an annular space 118 between the wall of the wellbore 12 and the outer surface of the drill string 22 to the surface 16 for removal.

Applications

One or more of the following applications may be realized when practicing some embodiments of the invention: (i) the reamer tool 28 may function as a wellbore conditioner, drill string stabilizer, and bi-directional reamer apparatus; (ii) the reamer tool 28 may allow reaming out sections of high frequency wellbore spiraling, key seats and doglegs while cleaning the wellbore and keeping the bottom hole assembly centralized; (iii) the reamer tool 28 may be used for vertical or horizontal wells to reduce the friction factor between the drill string and the wellbore, thus reducing the rotary torque while drilling and increasing the transfer of Weight on Bit; and (iv) as the wellbore is continuously reamed while drilling, the overall quality of the wellbore eliminates the need for the standard dedicated reamer run prior to running casing or multi-stage completions strings and the associated costs. This is achieved by the reamer tool 28 which combines engineered flow control, enhanced wellbore cleaning, reaming on a cleaned wellbore, and optimized positioning of cutters on radially insertable cutting inserts along the length of the reamer tool 28.

The particular embodiments disclosed above are illustrative only, as the present disclosure may be modified and practiced in different but equivalent manners apparent to those skilled in the art having the benefit of the teachings herein. While numerous changes may be made by those skilled in the art, such changes are encompassed within the scope of the subject matter defined by the appended claims. Furthermore, no limitations are intended to the details of construction or design herein shown, other than as described in the claims below. It is therefore evident that the particular illustrative embodiments disclosed above may be altered or modified and all such variations are considered within the scope of the present disclosure.

What is claimed is:

1. A wellbore reamer tool positionable on a drill string in a wellbore comprising:

a first helical impeller for cleaning the wellbore of formation cuttings in advance of reaming by first and second cutting portions, and directing the formation cuttings to a desired position on the first cutting portions;

the first and second cutting portions comprising a plurality of radially insertable cutter inserts comprising cutters for reaming the wellbore to yield the formation cuttings, the first helical impeller being below the first and second cutting portions;

an integral blade stabilizer positioned between the first and second cutting portions for supporting the tool while driving uphole flow of the formation cuttings; and a second helical impeller positioned above the first and second cutting portions for cleaning the wellbore and boosting newly incorporated formations cuttings up hole towards surface.

2. The tool of claim 1, further comprising a downhole end having a threaded pin connection for coupling to a bottom hole assembly or a drill pipe, and an uphole end having a threaded box connection for coupling to the drill string.

3. The tool of claim 1, further comprising downhole spiral hardbands positioned at the downhole end and uphole spiral hardbands positioned at the uphole end for proving erosion protection.

4. The tool of claim 1, wherein each of the first helical impeller and the second helical impeller comprises a plurality of helical blades and helical grooves between the helical blades for allowing uphole flow of formation cuttings therethrough.

5. The tool of claim 4, wherein the helical blades comprise odd blades and even blades on each of the first helical impeller and the second helical impeller, the even blades on the first helical impeller comprising straight-edged extension blades.

6. The tool of claim 1, wherein each of the first and second cutting portions comprises a bladed portion defining a plurality of pockets configured for mounting cutter inserts and wedge retainers.

7. The tool of claim 6, wherein the bladed portion comprises a plurality of substantially straight-edged and axially extending blades spaced evenly and radially around the bladed portion about a central longitudinal axis of the tool.

8. The tool of claim 7, wherein the pockets are spaced evenly and radially around the bladed portion about the central longitudinal axis, and positioned between the blades.

9. The tool of claim 8, wherein the pockets comprise rims defining notches, opposed end walls, opposed side walls, and bases for seating the cutter inserts, the bases defining apertures for receiving attachment means therethrough for securing the cutter inserts within the pockets.

10. The tool of claim 9, wherein the cutter inserts are positioned within the pockets, and spaced evenly and radially around the bladed portion about the central longitudinal axis, and positioned between the blades.

11. The tool of claim 10, wherein each cutter insert comprises a cutter insert body defining a first recess and a second recess configured for receiving the cutters, the cutters being arranged linearly in an inner row and an outer row and inclined at a predetermined angle.

12. The tool of claim 11, wherein each of the first and second recesses is aligned substantially parallel to each other, with the second recess being positioned below the first recess.

13. The tool of claim 12, wherein the cutters are evenly spaced apart in the first recess to be positioned in an alternating fashion with the cutters evenly spaced apart in the second recess.

14. The tool of claim 13, wherein the cutters comprise polycrystalline diamond compact cutters.

15. The tool of claim 13, wherein the cutter insert is secured within the pocket by fixedly attaching the wedge retainers to the bladed portion.

16. The tool of claim 15, wherein a wedge retainer is positioned at each end of the cutter insert body, and defines openings corresponding with the apertures in the bases of the pockets for receiving attachment means for securing the cutter insert to the blade portion.

17. The tool of claim 1, wherein the integral blade stabilizer comprises a plurality of substantially "S"-shaped stabilizer blades, and an outer diameter larger than outer diameters of the first cutting portion and the second cutting portion.

18. A method of enlarging a wellbore diameter comprising:

positioning in the wellbore a drill string including a wellbore reamer tool attached thereto, the wellbore reamer tool including:

a first helical impeller;

first and second cutting portions comprising a plurality of radially insertable cutter inserts comprising cutters, the first helical impeller being below the first and second cutting portions;

an integral blade stabilizer positioned between the first and second cutting portions; and a second helical impeller positioned above the first and second cutting portions; and moving the drill string and the wellbore reamer tool longitudinally in the wellbore while rotating the drill string and the wellbore reamer tool.

19. The method of claim 18, further comprising rotating the first helical impeller to clean the wellbore of formation cuttings in advance of reaming by the first and second cutting portions.

20. The method of claim 19, wherein the cutters engage and ream the radial wall of the wellbore to generate the formation cuttings, with an inner row of the cutters reaming before an outer row of the cutters.

21. The method of claim 20, further comprising rotating the integral blade stabilizer for driving uphole flow of the formation cuttings while supporting the wellbore reamer tool.

22. The method of claim 21, further comprising rotating the second helical impeller for cleaning the wellbore and boosting newly incorporated formations cuttings uphole towards surface.

* * * * *